US007537109B1

(12) United States Patent
Shevick

(10) Patent No.: US 7,537,109 B1
(45) Date of Patent: May 26, 2009

(54) RING PACKAGING

(75) Inventor: Barry L. Shevick, Fair Oaks, CA (US)

(73) Assignee: Glamour Rings of Hawaii, Inc., Sacramento, CA (US)

( * ) Notice: Subject to any disclaimer, the term of this patent is extended or adjusted under 35 U.S.C. 154(b) by 169 days.

(21) Appl. No.: 11/728,081

(22) Filed: Mar. 22, 2007

(51) Int. Cl.
*A45C 11/04* (2006.01)

(52) U.S. Cl. ..... 206/6.1; 206/482; 206/489; 206/493; 206/566

(58) Field of Classification Search ..... 206/6.1, 206/45.2–45.24, 18, 70, 301, 486–488, 493, 206/566, 763, 807; 211/85.2
See application file for complete search history.

(56) References Cited

U.S. PATENT DOCUMENTS 4,300,674 A * 11/1981 Davet ..... 206/6.1
4,880,117 A * 11/1989 Garganese ..... 206/487
5,547,072 A * 8/1996 Kaiser ..... 206/6.1
6,029,829 A * 2/2000 Ovadia ..... 211/85.2
6,065,589 A * 5/2000 Ouwens ..... 206/6.1
6,196,389 B1 * 3/2001 Buetter et al. ..... 206/493
6,866,143 B2 * 3/2005 Ovadia ..... 206/6.1
6,932,212 B2 * 8/2005 Ovadia ..... 206/6.1

* cited by examiner

*Primary Examiner*—Luan K Bui
(74) *Attorney, Agent, or Firm*—Heisler & Associates

(57) ABSTRACT

Packaging is provided that supports rings for display, allows rings to be sampled on a finger of a customer and which are secured to the ring to deter theft. The packaging has a top plate with an opening therein. The opening allows a portion of the ring to pass therethrough. A security stay passes through the ring and is coupled to the top plate with the security stay spanning the opening. A bottom plate is preferably also provided with a complemental form to that of the top plate. The security stay is trapped between the bottom plate and top plate to hold the security stay in place. Saddles are also preferably provided for lateral support of the ring and to allow the packaging to display the ring in an upright fashion while the packaging is resting upon a surface.

21 Claims, 3 Drawing Sheets

10
44
R
42
20
25
70
F 74
76
70
78
76
B
72
30
44
42
20
R
C
40
A
60
10
25
50

30
44
R
42
10
25
50
70
20

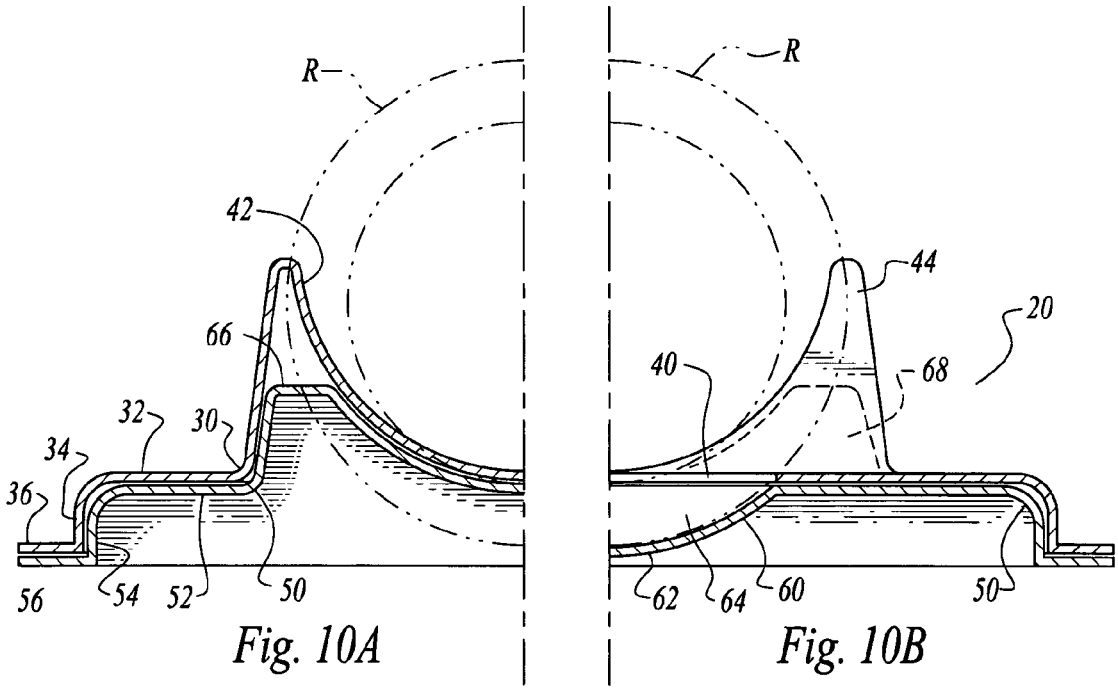
Fig. 10A
Fig. 10B
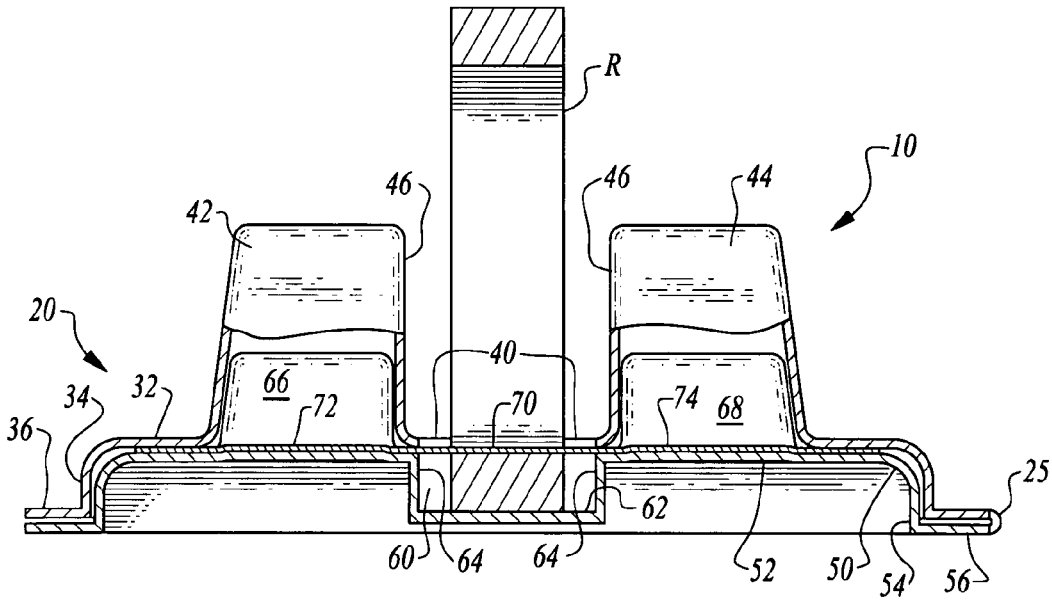
Fig. 11

RING PACKAGING

FIELD OF THE INVENTION

The following invention relates to packaging for rings, and particularly packaging which can remain attached to a ring both to display information associated with the ring and to deter theft of a ring from a retail establishment, while still allowing the ring to be temporarily worn by a customer sampling the ring. More particularly, this invention relates to packaging for a ring which remains securely attached to the ring but does not entirely contain the ring, but allows the ring to be worn by a customer sampling the ring.

BACKGROUND OF THE INVENTION

One problem commonly faced by ring retailers is balancing open access of customers to the ring merchandise, so that the customers can fully sample the ring merchandise, and deterring theft of the rings. In particular, rings are relatively small and can have a relatively high actual value or perceived value, such that they can be relatively easily stolen by placement into a thief's pocket or other hidden location. Such theft can often occur so innocuously that the retailer has no notice that the theft has taken place. Even if a ring is found to be missing there is often a lack of sufficient evidence connecting the thief to the crime, unless the retailer actually sees the ring being concealed by the thief.

One solution to this problem is to only allow customers to sample rings in a controlled environment and with the active presence of numerous sales personnel. Such carefully controlled access and monitoring is expensive both in the size of store or other retail location required to maintain such security and in maintenance of the salaries of the monitoring employees. Accordingly, a need exists for ring packaging which can both provide a customer with free access to the ring merchandise for sampling thereof, while also maintaining a high degree of security from theft. Such packaging would additionally benefit from being capable of displaying and supporting the ring in a desirable fashion to enhance an attractiveness of the ring and to present the ring in a most favorable orientation to encourage sales of ring merchandise contained within such packaging.

SUMMARY OF THE INVENTION

With this invention, ring packaging is provided which beneficially marries the benefits of theft deterrence with a high degree of access to the ring merchandise contained within the packaging, for sampling of the ring merchandise. In particular, the packaging includes a top plate, typically formed of plastic, which includes a substantially planar plateau with an opening extending through a central portion of the plateau. A security stay is provided with an elongate form spanning a width of the opening and located on an underside of the top plate. The opening is sized so that a ring can pass partially into the opening with the opening accommodating an entire width of the ring but preventing the ring from passing entirely through the opening due to a length of the opening being less than a diameter of the ring. The ring extends sufficiently far down into the opening that the security stay can pass through the ring. The security stay is coupled to the underside of the top plate so that the ring is thoroughly captured to the packaging.

The top plate preferably includes at least one saddle, and preferably two saddles extending up from the top plate on either side of the opening. These saddles have a curving surface extending between peaks of the saddles. A curvature of the saddles is preferably approximately similar to that of the ring that is to be supported by the packaging. Also, the saddles are aligned with the curving surfaces thereof curving about a common central axis which also is aligned with a central axis of the ring when coupled to the packaging. A finger of a user can be passed along the central axis, passing through the ring and over the saddles. A customer can thus try on the ring and determine whether or not to make a purchase without removing the ring from the packaging. While the security stay passes through the ring, the security stay is preferably relatively narrow and very thin (and also optionally slightly curved to match the ring curvature), such that a customer would only barely notice the presence of the security stay passing through the ring.

Most preferably, the top plate is only one portion of a two-part clamshell configuration also including a bottom plate. The bottom plate is preferably similar in form to the top plate in fashion so that it can pivot about a hinge relative to the top plate with portions of the bottom plate nesting within an underside of the saddles, such that the bottom plate is at least partially interlocked with the top plate. One way to secure the security stay to the top plate is merely by interposing the security stay between the top plate and the bottom plate. As an alternative, the security stay could be ultrasonically welded, heat welded, or otherwise securely fastened to either the top plate, the bottom plate or both the top plate and the bottom plate.

The saddles not only allow for access of a user's finger while the ring remains within the packaging, but also keeps the ring extending up from the packaging in a manner which allows the decorative details of the ring to be clearly viewed by a user when the packaging is resting flat upon a substantially horizontal surface. Thus, the packaging doubles as a display stand for the ring.

The top plate and other portions of the packaging can have any desired size and could also have a variety of different shapes. The shapes and sizes of the packaging can be sized, generally larger, to enhance a security associated with the packaging, due to the difficulty of concealing both a ring and associated large packaging within a pocket or other hidden location by a thief. Conversely, the packaging can be made smaller if the retailer wishes to balance the theft deterrence aspects of the packaging with the convenience of maintaining a larger inventory through having smaller packaging.

The security stay or other portions of the packaging can optionally include circuitry or other signaling components thereon which can interact with sensors within a retail establishment, such that an alarm or other notification can be provided should the packaging and associated ring leave the retail establishment in an unauthorized fashion. Such signaling components are known in the clothing and book retail arts for preventing theft or unauthorized removal of goods from a defined location. Also, it is conceivable that a security cable or chain of some kind could couple the packaging to a fixed object to provide an additional degree of theft deterrence.

OBJECTS OF THE INVENTION

Accordingly, a primary object of the present invention is to provide packaging for a ring to deter theft of a ring coupled to the packaging.

Another object of the present invention is to provide packaging for a ring which supports the ring upon a surface in a manner allowing the ring to be clearly seen and display its desirable aesthetic attributes.

Another object of the present invention is to provide a ring packaging which does not prevent a customer from sliding ones finger through the ring to sample the ring before making a purchase.

Another object of the present invention is to provide ring packaging which is securely coupled to the ring and difficult to remove from the ring.

Another object of the present invention is to provide ring packaging which is easy to attach to a ring and relatively difficult to remove from a ring.

Other further objects of the present invention will become apparent from a careful reading of the included drawing figures, the claims and detailed description of the invention.

BRIEF DESCRIPTION OF THE DRAWINGS

FIGS. 10A and 10B are partial sectional views taken along lines 10A-10A and 10B-10B of FIG. 8, revealing additional particular details of the preferred embodiment of the packaging of this invention.

FIG. 11 is a full sectional view of that which is shown in FIG. 9, taken along lines 11-11 of FIG. 9 and further revealing specific details of the packaging of this invention along with how it holds a ring to the packaging.

DESCRIPTION OF THE PREFERRED EMBODIMENT

Figures 1, 2, 3:
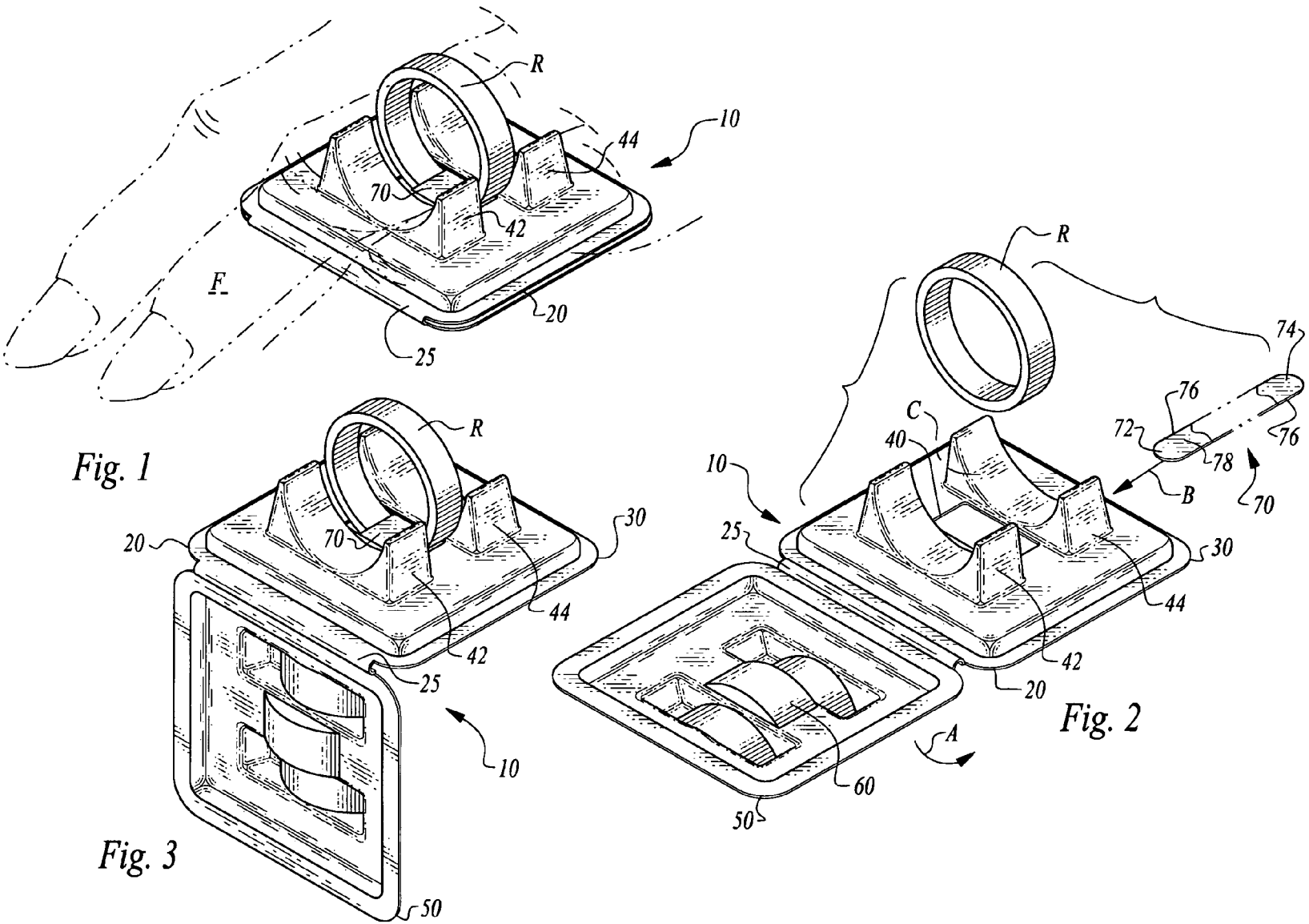
FIG. 1 is a perspective view of the ring packaging of this invention including a ring coupled thereto and with a hand of a customer shown in phantom with a finger passing through a ring thereof while the ring is coupled to the packaging.
FIG. 2 is an exploded parts view of the ring packaging portions including the top and bottom plates and the security stay exploded apart from each other and during the process of coupling a ring to the packaging.
FIG. 3 is a perspective view similar to that which is shown in FIG. 1 but before complete closing of the bottom plate adjacent to the top plate according to a preferred form of this invention.
Figure 4:
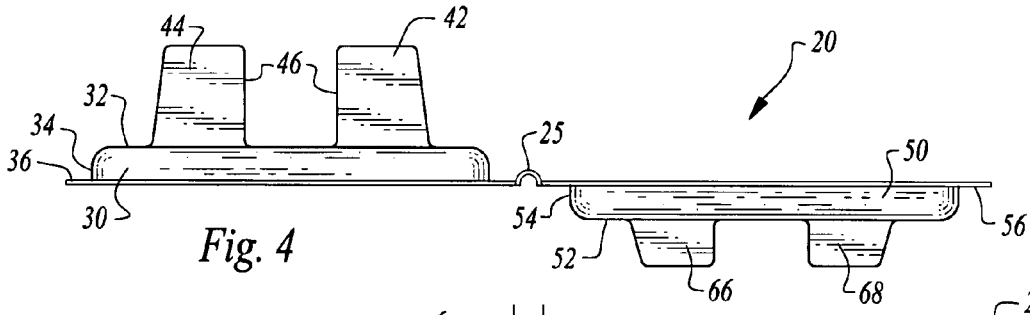
FIG. 4 is a front elevation view of the clamshell packaging including the top and bottom plates thereof.
Figure 5:
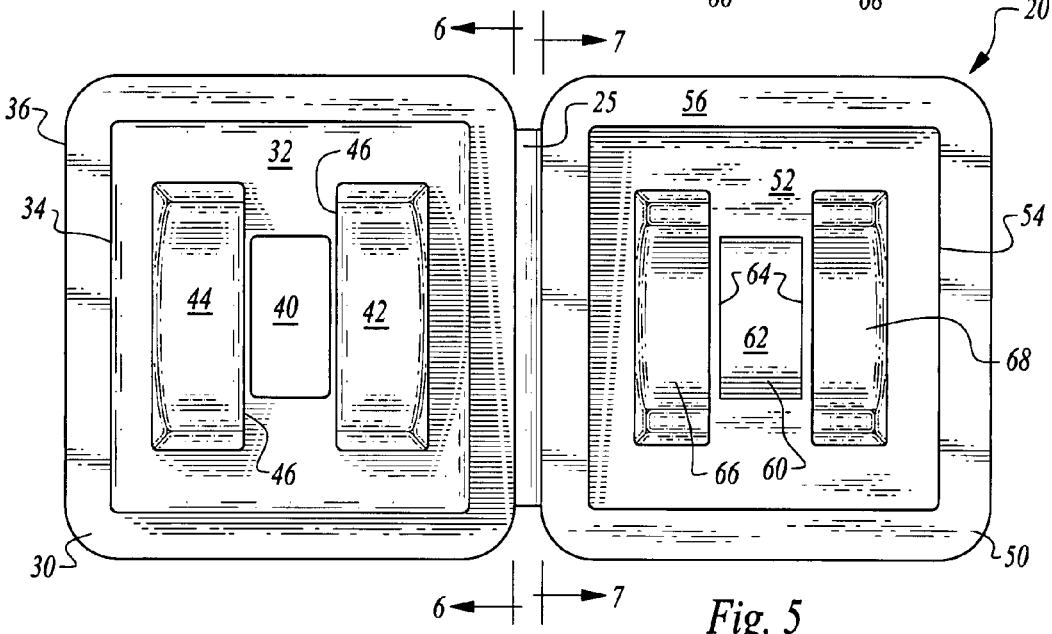
FIG. 5 is a top plan view of that which is shown in FIG. 4.
Figure 6:
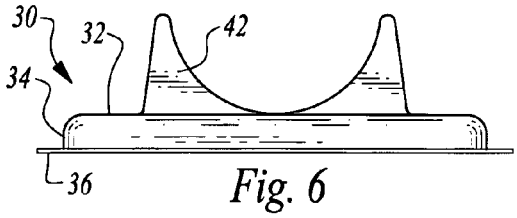
FIG. 6 is a sectional view of the packaging taken along lines 6-6 of FIG. 5 and illustrating details of the top plate.
Figure 7:
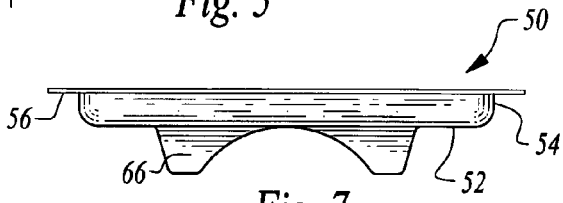
FIG. 7 is a full sectional view of that which is shown in FIG. 5, taken along lines 7-7 of FIG. 5 and revealing details of the bottom plate.

Referring to the drawings, wherein like reference numerals represent like parts throughout the various drawing figures, reference numeral 10 is directed to packaging for rings (FIG. 1). The packaging 10 keeps an opening of the ring R available for customers to sample the ring R on a finger F. The ring R is secured to the packaging 10 so that theft of the ring R is made more difficult. Also, the packaging 10 supports the ring R in an upright orientation so that the ring R can be more desirably displayed upon the underlying surface.

In essence, and with particular reference to FIGS. 1-3, basic details of the packaging 10 of this invention are described according to a preferred embodiment. The packaging 10 preferably is in the form of a clamshell 20 which joins together a top plate 30 and a bottom plate 50 about a hinge 25. Each of these plates 30, 50 are somewhat planar in form with a somewhat complemental shape. The bottom plate 50 is adapted to rotate about the hinge 25 so that the bottom plate 50 is directly adjacent an underside of the top plate 30 and with the bottom plate 50 at least partially nested into the top plate 30 so that the bottom plate 50 and top plate 30 interlock together somewhat.

An opening 40 passes through the top plate 30. This opening 40 is sized to accommodate a portion of a ring R extending through the opening 40. A recess 60 in the bottom plate 50 aligns with the opening 40. This recess 60 provides clearance for the portion of the ring R extending through the opening 40. A security stay 70 spans the opening 40 and is located between the top plate 30 and bottom plate 50. The security stay 70 passes through the ring R when the ring R extends down through the opening 40 in the top plate 30. The security stay 70 is coupled to the packaging 10 so that the ring R cannot be easily removed out of the opening 40 and away from the packaging 10, unless the security stay 70 is cut or the clamshell 20 of the packaging 10 is opened.

More specifically, and with particular reference to FIGS. 4-6 and FIGS. 10A, 10B and 11, details of the top plate 30 are described, according to the preferred embodiment. The top plate 30 is preferably provided as half of a clamshell 20 along with the bottom plate 50. However, the packaging 10 could be provided in a most simple embodiment with only the top plate 30, without the bottom plate 50.

The top plate 30 includes a generally planar plateau 32 surrounding the opening 40. This plateau 32 terminates at a perimeter wall 34 which preferably extends substantially perpendicularly down from a plateau 32 to an edge flange 36. The edge flange 36 is preferably parallel with the plateau 32 but lower than the plateau 32 and extending laterally from a lower edge of the perimeter wall 34.

Preferably, the top plate 30 is formed entirely from moldable plastic, such as plastic which is often described as "blister pack" due to the method of molding utilized. Such plastic material is preferably at least partially transparent, with a polymeric hydrocarbon material providing a composition for the formation of the top plate 30, such as polyethylene. Preferably, this top plate 30 is of uniform thickness, with a thickness of approximately 0.5 millimeter. Most preferably the top plate 30 is pressure formed along with the bottom plate 50 and other portions of the clamshell 20 including the hinge 25. The hinge 25 can optionally be made slightly thinner to accommodate pivoting (along arrow A of FIG. 2) between the top plate 30 and the bottom plate 50.

The top plate 30 preferably also includes at least one saddle, and preferably a pair of saddles including a first saddle 42 and a second saddle 44 extending up from the plateau 32. The saddles 42, 44 are preferably formed by contouring of the mold forming the top plate 30, so that the top plate 30 is a continuous structure inboard of the edge flange 36, other than where the opening 40 is provided. The saddles 42, 44 preferably each include a pair of peaks at extreme left and right sides thereof with a curving wall extending between the two peaks.

Figure 8:
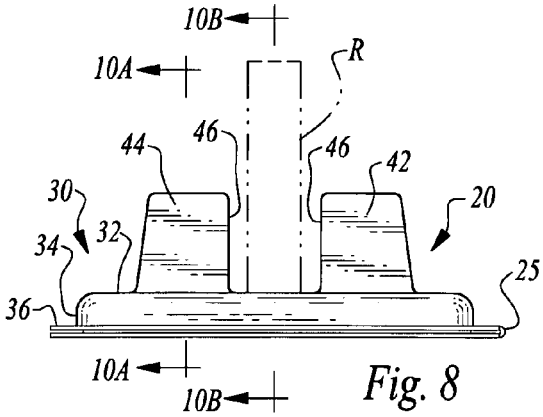
FIG. 8 is a side elevation view of that which is shown in FIG. 1 and with a ring shown in phantom adjacent thereto.
Figure 9:
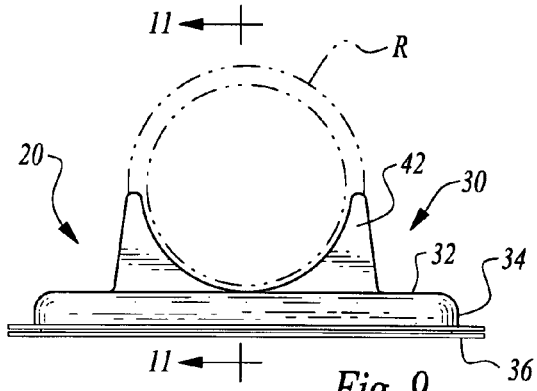
FIG. 9 is a front elevation view of that which is shown in FIG. 1 and with a ring shown in phantom coupled to the packaging.

The inside walls 46 of each of the saddles 42, 44 face the opening 40 and toward each other. These inside walls 46 provide for lateral support of the ring R (as best shown in FIG. 8). The curvature of the saddles 42, 44 between the peaks preferably approximates a curvature of the ring R. The saddles 42, 44 are preferably symmetrically oriented about the opening 40 so that when the ring R is located with a portion of the ring R extending down through the opening 40, that the curving surfaces of the saddles 42, 44 are generally aligned with the curving surface of the ring R about a common axis of curvature for the ring R and saddles 42, 44. This axis of curvature would also be a centerline along which a finger F (FIG. 1) of a customer would pass when trying on the ring R while continued within the packaging 10.

The opening 40 preferably has a width between the two saddles 42, 44 and a length perpendicular to the width. This opening width and opening length define the opening 40 as generally rectangular. The width of the opening 40 is sized at least as large as a width of the ring R, and preferably slightly greater than a width of the ring R to accommodate rings of different widths with a standard packaging size. The length of the opening 40 is preferably less than a diameter of the ring R so that the ring R cannot pass entirely through the opening 40. Rather, when the ring R is placed within the opening 40, an entire width of the ring R is accommodated within the opening 40, but the ring R can only extend partially down into the opening 40 before it abuts ends of the opening 40 spaced apart by the length of the opening 40. The length of the opening 40 is selected so that when the ring R is placed within the opening 40, the ring R extends sufficiently down into the opening 40 that the security tab 70 can pass linearly through the ring R (along arrow B of FIG. 2) when directly adjacent an underside of the top plate 30 and spanning the opening 40 across the width of the opening 40.

With particular reference to FIGS. 4, 5, 7, 10A, 10B and 11, particular details of the bottom plate 50 are described. The bottom plate 50 is preferably formed along with the top plate 30 as a second portion of the clamshell 20. The bottom plate 50 is preferably provided primarily to entrap the security stay 70 between the top plate 30 and bottom plate 50 so that the ring R cannot be removed from the packaging 10. The bottom plate 50 also adds additional rigidity to the overall packaging 10 by nesting at least partially with the top plate 30 such that a partially interlocking configuration is provided. The bottom plate 50 is preferably formed of common materials and with a similar thickness to that of the top plate 30. The bottom plate 50 thus includes an undersurface 52 which faces upward before pivoting of the bottom plate 50 about the hinge 25 and faces downward after pivoting of the bottom plate 50 (FIG. 10A).

An edge wall 54 extends perpendicularly up from the undersurface 52 to an edge flange 56. The undersurface 52 is adapted to be generally planar with the plateau 32 and adjacent an underside of the plateau 32 when the bottom plate 50 is pivoted to the final position adjacent the top plate 30. The edge wall 54 of the bottom plate 50 is sized to be adjacent to the perimeter wall 34 of the top plate 30, and allowing the undersurface 52 of the bottom plate 50 to nest within an underside of the top plate 30 adjacent the plateau 34. The edge flange 56 is similar in form to the edge flange 36 of the top plate 30 so that the edge flange 56 of the bottom plate 50 can be located adjacent the edge flange 36.

The bottom plate 50 is preferably fastened to the top plate 30 in some fashion. Such coupling can be through the security stay 70 coupling, or a separate form of coupling. For instance, ultrasonic welding can be utilized to secure the bottom plate 50 to the top plate 30, such as along the edge flanges 36, 56 or between the perimeter wall 34 and edge wall 54. As another alternative, various forms of welding can be utilized or other heat application can be utilized to at least partially fuse portions of the top plate 30 to portions of the bottom plate 50. Other forms of fastening could be utilized within the bottom plate 50 and top plate 30 including mechanical fasteners or adhesives.

The bottom plate 50 preferably includes a recess 60 which is oriented adjacent the opening 40 when the bottom plate 50 is pivoted into position adjacent the top plate 30 (along arrow A of FIG. 2). This recess 60 includes a floor 62 which preferably curves with a curvature similar to that of the curving walls of the saddles 42, 44 and a curvature similar to that of the ring R. Sides 64 extend up from the floor 62 to a plane in which the undersurface 52 is oriented. The recess 60 can thus be located directly below the opening 40 and accommodate portions of the ring R extending through the opening 40. The recess 60 keeps the ring R from extending entirely through the packaging 10. As an alternative, the recess 60 could be a second hole similar to that of the opening 40 and the ring R could be allowed to pass partially through the entire packaging 10.

The bottom plate 50 also preferably includes a first saddle insert 66 and a second saddle insert 68. These saddle inserts 66, 68 are shaped, sized and located to nest into the first saddle 42 and second saddle 44 of the top plate 40 when the bottom plate 50 is rotated into position adjacent the top plate 30. Preferably, the saddle inserts 66, 68 have peaks which are truncated slightly relative to the peaks of the saddles 42, 44 of the top plate 30. The saddle inserts 66, 68 preferably have a curving wall between peaks thereof which matches a curvature of the saddles 42, 44 of the top plate 30. The saddle inserts 66, 68 cause the bottom plate 50 to interlock with the top plate 30 when the bottom plate 50 is rotated into position adjacent the top plate 30. Such interlocking helps to stiffen the overall packaging 10 and helps to secure the security stay 70 between the top plate 30 and bottom plate 50 in the desired position spanning the opening 40.

With particular reference to FIGS. 2 and 11, particular details of the security stay are described, according to the preferred embodiment. The security stay 70 preferably passes under the top plate 30 (along arrow B of FIG. 2 and under the opening 40 in an orientation spanning the width of the opening 40 and perpendicular to a line extending along the length of the opening 40. This security stay 70 is configured so that it can pass through the ring R and hold the ring R down into the opening 40 of the packaging 10.

To secure the ring R within the packaging 10, first the ring R is placed extending partially into the opening 40 (along arrow C of FIG. 2). Next, the security stay 70 is passed under the top plate 30 and through the ring R (along arrow B of FIG. 2). Once this security stay 70 is entirely in place (FIG. 11) the bottom plate 50 is rotated (about arrow A of FIG. 2) about the hinge 25 until the bottom plate 50 is adjacent the top plate 30 and the security stay 70 has been trapped between the bottom plate 50 and the top plate 30. Preferably, an additional fastening step occurs to fasten the bottom plate 50 to the top plate 30 and preferably also to secure the security stay 70 to at least the top plate 30. If the bottom plate 50 is not utilized, it is required that the security stay 70 be somehow securely attached to the top plate 30, preferably to an underside of the top plate 30, but also conceivably fastened securely to an upper side of the top plate 30 spanning the opening 40.

The security stay 70 is preferably elongate in form with a length between a first tip 72 and second tip 74 which is at least as long as the width of the opening 40, and preferably as long as an entire width of the plateau 32 between opposite portions of the perimeter wall 34 (FIG. 11). By making the security stay 70 longer, it is less likely to be pulled out through the opening 40. The security stay 70 includes sides 76 extending between the first tip 72 and second tip 74. Surfaces 78 face upward and downward on the security stay 70.

While the security stay 70 is shown in its preferred embodiment having a simple generally elongate rectangular form that is flat and with rounded ends, the security stay 70 could be altered in a variety of different ways to provide different beneficial attributes for the security stay 70. For instance, at the tips 72, 74 or other ends, the security stay 70 could bend downward 90° and follow the edge wall 54 and perimeter wall 34 between the bottom plate 50 and top plate 30 to most securely hold the security stay 70 between the top plate 30 and bottom plate 50.

Also, it is conceivable that the security stay 70 could have a slight curvature curving about an axis of curvature extending parallel with a long axis of the security stay 70 extending between the first tip 72 and second tip 74. This axis of curvature would preferably be common with an axis of curvature for the curving surfaces of the saddles 42, 44 and a centerline of the ring R. With such curvature, the security stay 70 would be able to be least intrusive to a user sampling the ring R in that the security stay 70 would have its curvature match a curvature of the ring R on a portion of the security stay 70 which passes through the ring R along with the finger F of the user (FIGS. 1 and 3). Such slight curvature for the security stay 70 might also slightly enhance a rigidity of the security stay 70, allowing the security stay 70 to either be more secure within the packaging 10 or be able to be made thinner and still maintain a desired degree of rigidity.

While the packaging 10 has been shown here in its preferred embodiment, this packaging 10 illustrates a relatively small overall size for supporting of the ring R. If theft deterrence is to be magnified, the packaging 10 can be increased in size either to maintain a generally square plan form but larger, or to take on a different shape, such as a more rectangular shape. When making the packaging 10 larger, it becomes more and more difficult to place the ring and packaging within a pocket or other concealed location for theft. Also, larger packaging would provide a greater amount of space for information such as marketing information to be attached to the packaging. Such marketing information would typically be secured to the undersurface 52 of the bottom plate 50 and be visible both through the transparent plastic forming the plateau 32 of the top plate 30 and be visible by looking at an underside of the packaging 10 and seeing the packaging insert directly. As another alternative, such a packaging insert could be nested between the top plate 30 and the bottom plate 50.

In addition to merely providing the packaging 10 with sufficient bulk to deter theft, other such deterrent devices could be attached to the packaging to further enhance theft deterrence. For instance, signaling components could be attached to the packaging that are particularly configured to be detected by a detector such as one that could be placed near a store entrance. Such theft deterrent components could be any of a variety of different components including RFID chips, magnetic strips sensitive to different detectors, or other signaling components known in the retail art for theft deterrence. When the ring is purchased, the theft deterrent component would be deactivated or removed from the packaging, or an alternate exit from the retail location could be provided for properly purchased merchandise. By securing the packaging 10 to the ring R, a variety of locations are provided for the placement of such signaling components so that such signaling components need not be attached directly to the ring R itself.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. Packaging for a ring, comprising in combination:
a top plate having an opening therethrough;
said opening adapted to allow a portion of a ring to extend therethrough;
a bottom plate located below and adjacent said top plate;
a security stay located between said plates and adapted to pass through the ring;
wherein said security stay is secured to at least one of said top plate and said bottom plate;
wherein said security stay is secured to both said top plate and said bottom plate; and
wherein said security stay is elongate in form with ends of said security stay extending downward perpendicular to portions of said security stay between said ends.

2. The packaging of claim 1 wherein said top plate and said bottom plate are secured together on opposite sides of a hinge, said hinge adapted to allow said top plate and said bottom plate to pivot relative to each other through at least 180° of rotation.

3. The packaging of claim 2 wherein said security stay is secured to at least one of said top plate and said bottom plate.

4. Packaging for a ring, comprising in combination:
a top plate having an opening therethrough;
said opening adapted to allow a portion of a ring to extend therethrough;
a bottom plate located below and adjacent said top plate;
a security stay located between said plates and adapted to pass through the ring; and
wherein said bottom plate has a recess located adjacent said opening in said top plate when said bottom plate is oriented adjacent said top plate, said recess adapted to reside entirely below the ring when the ring has a portion thereof extending through said opening in said top plate.

5. Packaging for a ring, comprising in combination:
a top plate having an opening therethrough;
said opening adapted to allow a portion of a ring to extend therethrough;
a bottom plate located below and adjacent said top plate;
a security stay located between said plates and adapted to pass through the ring; and
wherein said top plate includes at least one saddle extending up from a substantially planar plateau on said top plate, said saddle adapted to at least partially support the ring with a central axis of said ring parallel with and spaced from said plateau.

6. The packaging of claim 5 wherein said at least one saddle has a curving surface extending between a pair of peaks, said saddle adapted to provide lateral support to the ring while allowing a finger of a customer to pass through the ring to try on the ring without removing the ring from said packaging.

7. The packaging of claim 5 wherein said bottom plate includes at least one insert that extends at least partially into said saddle from an underside of said top plate, such that said bottom plate and said top plate are at least partially interlocked together.

8. The packaging of claim 5 wherein said top plate and said bottom plate are secured together on opposite sides of a hinge, said hinge adapted to allow said top plate and said bottom plate to pivot relative to each other through at least 180° of rotation.

9. Ring packaging facilitating ring sampling without removal from the packaging, the ring packaging comprising in combination:

a top plate having an opening therethrough, said opening surrounded by said top plate;

said opening having a width adapted to accommodate a width of a ring extending into said opening;

said opening having a length perpendicular to said width adapted to allow the ring to only pass partially through said opening;

a security stay adapted to be coupled to said top plate and adapted to span said width of said opening;

said security stay adapted to be oriented adjacent said opening passing through the ring, such that said security stay is adapted to prevent removal of the ring fully out of said opening and away from said top plate; and wherein said top plate includes at least one saddle extending up from a substantially planar plateau on said top plate, said saddle adapted to at least partially support the ring with a central axis of said ring parallel with and spaced from said plateau.

10. The ring packaging of claim 9 wherein said security stay is adapted to be coupled to an underside of said top plate.

11. The ring packaging of claim 9 wherein said top plate and said security stay are each formed of plastic, said security stay coupled to said top plate by ultrasonic welding.

12. The ring packaging of claim 9 wherein said top plate and said security stay are each formed of plastic, said security stay coupled to said top plate by welding of said security stay to said top plate including welding by applying heat to the security stay and the top plate.

13. The ring packaging of claim 12 wherein said at least one saddle has a curving surface extending between a pair of peaks, said saddle adapted to provide lateral support to the ring while allowing a finger of a customer to pass through the ring to try on the ring without removing the ring from said packaging.

14. The ring packaging of claim 9 wherein said security stay is elongate in form having a curve curving about an axis of curvature parallel with a long axis of said security stay.

15. The ring packaging of claim 9 wherein said packaging includes a bottom plate coupled to said top plate, said security stay adapted to be secured to said top plate at least partially by interposing said security stay between said top plate and said bottom plate.

16. The ring packaging of claim 15 wherein said top plate and said bottom plate are secured together on opposite sides of a hinge, said hinge adapted to allow said top plate and said bottom plate to pivot relative to each other through at least 180° of rotation.

17. Ring packaging facilitating ring sampling without removal from the packaging, the ring packaging comprising in combination:

a top plate having an opening therethrough, said opening surrounded by said top plate;

said opening having a width adapted to accommodate a width of a ring extending into said opening;

said opening having a length perpendicular to said width adapted to allow the ring to only pass partially through said opening;

a security stay adapted to be coupled to said top plate and adapted to span said width of said opening;

said security stay adapted to be oriented adjacent said opening passing through the ring, such that said security stay is adapted to prevent removal of the ring fully out of said opening and away from said top plate;

wherein said packaging includes a bottom plate coupled to said top plate, said security stay adapted to be secured to said top plate at least partially by interposing said security stay between said top plate and said bottom plate; and wherein said security stay includes legs at ends thereof, said legs extending downwardly from a plane in which portions of said security stay between said ends are oriented.

18. A theft deterrent ring and ring packaging combination comprising:

a top plate having an opening therethrough;

said opening surrounded by said top plate;

a ring having a ring width less than a ring diameter;

said opening having a width at least as great as said ring width;

said opening having a length perpendicular to said opening width that is less than said ring diameter;

a portion of said ring located extending through said opening;

a security stay coupled to said top plate and spanning said width of said opening;

said security stay passing through said portion of said ring located extending through said opening; and wherein said top plate includes at least one saddle extending up from a substantially planar plateau on said top plate, said saddle adapted to at least partially support said ring with a central axis of said ring parallel with and spaced from said plateau.

19. The combination of claim 18 wherein said security stay is coupled by direct affixation to an underside of said top plate.

20. The combination of claim 18 wherein a bottom plate is provided oriented substantially parallel with said top plate, said security stay coupled to said top plate by interposing of said security stay between said bottom plate and said top plate.

21. The combination of claim 18 wherein said at least one saddle has a curving surface extending between a pair of peaks, said saddle adapted to provide lateral support to said ring while allowing a finger of a customer to pass through said ring to try on said ring without removing said ring from said packaging.

* * * * *